US008591840B2

(12) United States Patent
Rethwisch et al.

(10) Patent No.: US 8,591,840 B2
(45) Date of Patent: Nov. 26, 2013

(54) CARRIER FOR PIPETTE TIPS

(75) Inventors: Hanna Rethwisch, Hamburg (DE); Michael Blumentritt, Hamburg (DE)

(73) Assignee: Eppendorf AG, Hamburg (DE)

( * ) Notice: Subject to any disclaimer, the term of this patent is extended or adjusted under 35 U.S.C. 154(b) by 0 days.

(21) Appl. No.: 12/691,198

(22) Filed: Jan. 21, 2010

(65) Prior Publication Data

US 2010/0266457 A1 Oct. 21, 2010

Related U.S. Application Data

(60) Provisional application No. 61/146,818, filed on Jan. 23, 2009.

(51) Int. Cl.
*B01L 9/00* (2006.01)

(52) U.S. Cl.
USPC ..... 422/564

(58) Field of Classification Search
USPC ..... 422/564, 561, 562; 211/74, 126.7, 211/126.12
See application file for complete search history.

(56) References Cited

U.S. PATENT DOCUMENTS

| | | | | |
|---|---|---|---|---|
| 4,510,119 | A | 4/1985 | Hevey | |
| 5,588,792 | A | 12/1996 | Tiso | |
| 5,801,055 | A * | 9/1998 | Henderson | 435/297.5 |
| 6,106,783 | A * | 8/2000 | Gamble | 422/553 |
| 6,132,684 | A | 10/2000 | Marino | |
| 6,221,317 | B1 * | 4/2001 | Carl | 422/564 |
| 7,666,362 | B2 * | 2/2010 | Shanler | 422/401 |
| 2003/0129089 | A1 | 7/2003 | Arnold, Jr. et al. | |
| 2006/0045815 | A1 | 3/2006 | Hovatter | |
| 2006/0093530 | A1 | 5/2006 | Ueda | |

FOREIGN PATENT DOCUMENTS

| | | | |
|---|---|---|---|
| EP | 1 364 710 | A2 | 11/2003 |
| JP | 2000-221 200 | A | 8/2000 |
| WO | 03/064271 | A2 | 1/2010 |

* cited by examiner

*Primary Examiner* — Paul Hyun

(74) *Attorney, Agent, or Firm* — Vidas, Arrett & Steinkraus

(57) ABSTRACT

A carrier for pipette tips, with a frame, featuring four side walls, a plate with a plurality of holes for inserting pipette tips, and a mechanism for detachably connecting the frame and the plate, that have contact surfaces on the upper edge of the frame and on the underside of the plate, which touch each other when the plate is put onto the frame, and that have guiding elements directed transversally to the contact surfaces on the frame and on the plate, which engage into each other with lateral clearance when the plate is put onto the frame.

20 Claims, 14 Drawing Sheets

Detail "Z"

CARRIER FOR PIPETTE TIPS

CROSS-REFERENCE TO RELATED APPLICATIONS

This application claims priority to U.S. Provisional Patent Application No. 61/146,818 filed Jan. 23, 2009, the entire contents of which are incorporated herein by reference

STATEMENT REGARDING FEDERALLY SPONSORED RESEARCH

Not applicable

BACKGROUND OF THE INVENTION

The present invention is related to a carrier for pipette tips, for those in automatic machines in particular.

Carriers for pipette tips serve for keeping and providing pipette tips made of plastic material for utilisation. They have an edge with four upwardly projecting side walls and a plate, disposed on the upper edge of the frame and having a plurality of holes in a matrix arrangement. Pipette tips are put into the holes from out the upside, wherein they do not fall through the holes due to a diameter that widens towards the upside, or due to a collar. The frame is adapted to be put onto a support with its lower edge or a bottom. The pipette tips are held at a distance from the support by the carrier. One or plural pipette tips may be taken out of the carrier by means of a pipetting—or metering apparatus, respectively. For this purpose, the metering apparatus is pressed into the upper opening of one or plural pipette tips with one or plural studs. After use, the pipette tips are normally put into a carrier or given off into a container with the aid of a throw-off device of the metering apparatus, in order to be disposed of.

Carriers for pipette tips are known wherein the frame is covered by a bottom at the downside, and by a detachable cover cap on the upside. In these box-like carriers, the pipette tips are protected against contaminations. Before taking out pipette tips, the cover cap has to be removed.

From WO 00/51899 A1, the entire contents of which is incorporated herein by reference, a refill package for re-usable carriers for pipette tips is known. The refill package comprises a plate with holes in a matrix arrangement, into which pipette tips are inserted, and a flexible cover cap in which the plate is held. When putting the cover cap onto the upper edge of a carrier, the side walls of the cover cap are laterally deflected, so that the plate clamped in there between is released. As a consequence, the plate with the pipette tips falls into a reception piece of the carrier that is surrounded by an enclosure. Refilling the carrier with pipette tips and taking out the plate with pipette tips from the carrier are performed manually.

In automatic metering machines and automatic laboratory machines ("workstations") that include metering apparatuses, pipette tips made of plastic material are frequently employed. Automatic metering machines and automatic laboratory machines will be designated as "automatic machines" in the following. The known refill package is not well suited for the utilisation in automatic machines. Displacement of the cover cap by an automatic machine in order to separate plate and cover cap would be problematic due to the cover cap's flexibility. When the plate is disposed in the carrier, the lateral enclosure encumbers the removal by an automatic machine.

From U.S. Pat. No. 6,221,317 B1, the entire contents of which is incorporated herein by reference, a box for pipette tips is known which features a lower part with a bottom and side walls, which end up in support surfaces at the upside. A plurality of locking elements is asymmetrically disposed on the support surfaces. A plurality of inner walls projecting upward from the bottom is adjacent to a plurality of inner accommodations. A plate portion features a first set of holes, into which the locking elements are inserted. Further, it has a second set of holes for the insertion of pipette tips. The locking elements are realised as locking pins, which engage by frictional fit into the first set of holes of the plate. Thus, plate and lower part are detachably fixed to each other by way of the pins and bores. However, detaching the plate from the lower part is only possible by the expenditure of a force that is greater than the weight force of lower part and plate. The user can choose among plates having 96, 348 an 1536 holes for inserting pipette tips. He can fix the selected plate on the lower part by way of the locking pins and the holes. Thereafter, he may insert the pipette tips into the holes and place a cover cap over the plate.

The grid-like subdivision of the interior space provides the box with a stiffness sufficient for handling by an automatic machine. Automatic refilling of pipette tips into the box would be a problem. In particular, replacing a plate by a plate equipped with new syringes would be hard to perform for an automatic machine. That is to say, this would require a very accurate positioning of the holes above the locking pins that must be pressed in, and an accurate insertion of the pipette tip into the interior space that is subdivided by inner walls. This could not be managed by conventional automatic machines. Thus, it is a disadvantage of such a box that the pipette tips hit the grid-like subdivision when being inserted, and fall out of the plate.

Starting from this, the present invention is based on the objective to provide a carrier for pipette tips which is particularly suited for the utilisation in automatic machines. That is to say, the carrier is distinguished by its particular stability and its suitability for being handled by automatic elements (like gripping arms, metering head e.g.). Thus, an essential aspect of the objective is to provide a carrier whose plate and frame cannot be separated without intent, by errors of the automatic machine e.g., but whose elements (plate and frame) can be detached simply when this is intended.

BRIEF SUMMARY OF THE INVENTION

The carrier for pipette tips of the present invention has:

- a frame, featuring four side walls,
- a plate with a plurality of holes for inserting pipette tips, and
- means for detachably connecting the frame and the plate,
  - that have contact surfaces on the upper edge of the frame and on the underside of the plate, which touch each other when the plate is put onto the frame, and
  - that have guiding elements directed transversally to the contact surfaces on the frame and on the plate, which engage into each other with lateral clearance when the plate is put onto the frame.

In the carrier of the present invention, the means for detachably connecting the frame and the plate have contact surfaces touching each other on the upper edge of the frame and on the lower side of the plate. Further, they comprise guiding elements of carrier and plate that engage into each other transversally to the contact surfaces with lateral clearance. The guiding elements are preferably aligned vertically to the contact surfaces. Yet, they may also be aligned inclinedly to the contact surfaces. Due to the arrangement of the contact surfaces, the plate is covered laterally not at all or only in parts by the frame. As a consequence, a gripping tool of an automatic machine can have access to the edges of the plate, in order to put a plate onto the frame or to take it away from the frame. Thus, the edges of the plate are adapted for the transportation by a gripping tool. The plate is relatively stiff in the direction of this load by a gripping tool, so that it resists the clamping force of the gripping tool and can be safely held by the same. By the engaging guiding elements of the means for detachably connecting, the plate is safely held on the frame. The guiding elements of frame and plate engage into each other with lateral clearance. The joining of plate and frame is facilitated by this clearance between the engaging guiding elements, so that it may be performed more easily automatically. This holds also for lifting the plate from the frame when an empty plate is to be replaced by a filled plate. The parts of plate and frame engaging with clearance match can compensate for inaccuracies of an automatically operated gripping device. A plate pre-filled with pipette tips can be put onto the frame, so that the carrier can be filled with pipette tips automatically. The plate may feature e.g. 24, 48, 96, 384 or 1536 holes for inserting pipette tips. In case that a hooked-up pipette tip occurs in an erroneous withdrawal by a metering tool, and the plate is lifted along with the pipette tip through this and is in danger to fall out, there will be a toe-in between the guiding elements that engage with lateral clearance resulting in a release of the hooked-up pipette tip from the plate, so that the plate slips back into the frame into its original position. Thus, this intended toe-in prevents unintended separation of the plate from the frame and increases the safety of the automatic processes. In particular, the continuation of the automatic pipetting process is made sure in this way, without that any manual intervention is necessary.

The present invention incorporates embodiments wherein the frame and the plate are each one provided with only two guiding elements, which can be brought into engagement with each other. Preferably, the frame and the plate have plural guiding elements each, four in particular, a guiding element of the plate being associated to each guiding element of the frame and the associated guiding elements being adapted to be brought into engagement with each other. The associated guiding elements of frame and plate are arranged on different positions of frame and plate.

They are preferably arranged at opposing side walls of the frame and at opposing edges of the plate. Further preferably, they are arranged at diametrically opposing positions of the side walls and of the edges of the plate.

The guiding elements that are adapted to be brought into engagement with lateral clearance can be realised in different ways. For instance, it is dealt with an upper opening of the frame and a collar at the lower side of the plate that is adapted to be inserted into the upper opening with clearance. According to a preferred embodiment, the guiding elements feature columns and bores suitable for insertion of the columns with lateral clearance, and/or ribs and grooves that are suitable for insertion of the ribs with lateral clearance. Due to the clearance match, the inner diameter of the bores or the width of the grooves, respectively, exceeds the outer diameter of the columns or the wall width of the ribs, respectively. According to a further embodiment, the columns and/or the ribs project from the upper edge of the frame and the plate features the bores and/or grooves at the underside. However, the invention incorporates also embodiments in which the columns and/or the ribs project from the underside of the plate and the upper edge of the frame features the bores and/or grooves. Finally, embodiments are incorporated in which the upper edge of the frame features columns and/or ribs and bores and/or grooves, and the underside of the plate features corresponding bores and/or grooves and columns and/or ribs. The bores may be through bores or blind bores, and the grooves may have a groove bottom or may be realised as through slits.

The columns may have different shapes. For instance, they may be cylindrical and have a circular or polygonal cross section. The same holds for the bores in a corresponding way. The ribs may have a constant wall thickness. Further, they may have a straight, angled or curved course. Corresponding holds for the grooves.

According to a preferred embodiment, the columns taper at least in sections in the direction towards their free end, and/or the bores widen up at least in sections in the direction towards their insertion openings for the columns. The columns may also taper over their entire height and/or the bores may widen up over their entire depth. Further, the ribs can taper at least in sections in the direction towards their free end, and the grooves may widen up at least in sections in the direction towards their insertion openings for the ribs. But however, the ribs may taper over their entire height and/or the grooves may widen up over their entire depth. The tapering columns or ribs and the widening bores or grooves facilitate the joining of the plate with the frame, and thus they favour the handling by automatic machines. According to a further embodiment, the columns and the bores are arranged on the corners of the frame and the plate. Further, the invention incorporates embodiments wherein the columns and the bores are arranged between the corners of the frame and the plate.

According to a further embodiment, the frame features a waistline. The waistline favours a positive fit and safe grasping of the entire carrier by way of a gripping device of an automatic machine. Thus, the waistline is favourable for a safe and accurate positioning of the entire carrier. Due to the waistline, the carrier may be grasped safely with less gripping force. In principle it is sufficient that the waistline be formed by two opposing side walls of the frame. Preferably it is formed between all the opposing side walls, so that the carrier can be grasped safely from out two directions.

For instance, the waistline may be formed by deepenings in the outer side of opposing side walls. According to one embodiment, the waistline is limited at its upside by an outwardly protruding upper projection of the frame. This limitation can prevent the carrier from falling out of a gripping device. Further, the waistline can be limited at the downside by an outwardly protruding lower projection of the frame. By the shaping of the waistline, the bending force when it is grasped by way of a gripping device can be optimised, so that the frame resists the loads through the gripping device.

The present invention incorporates embodiments wherein the frame is open at the downside. This frame is adapted to be put onto a support with a lower edge. According to one embodiment, the frame is closed at the downside by a bottom. The bottom protects pipette tips against contaminations from out the downside. The lower projection may be formed by an edge of the bottom that projects towards the outside over the side walls.

According to a further embodiment, the dimensions of the ground area of the frame coincide with the dimensions of the ground area of microtiter plates according to the standard of the Society for Biomolecular Screening (SBS). This standard has been published by the American National Standards Institute (ANSI) with the designation ANSI/SBS 1-2004 and is designated as the "SBS Standard" in the following. According to this, a microtiter plate has a ground area ("Footprint") with a length of 127.76 mm and a width of 85.48 mm. The ground area of the frame has the same dimensions. Conventional automatic machines feature bearing positions for microtiter plates that have the mentioned dimensions. These bearing positions are provided with guiding—and clamping devices which are matched to the mentioned dimensions. These bearing positions and guiding—and clamping devices can be used for positioning the carrier that has a ground area according to SBS Standard. A waistline permits to conform with the standard even in case that the frame has a lateral projection at the upside for supporting it on a gripping tool.

According to a preferred embodiment, the frame has a free cross section between the side walls. In this embodiment, the side walls are not connected between each other by inner walls, like in the carrier according to U.S. Pat. No. 6,221,317 B1. As a consequence, putting up a plate with inserted pipette tips cannot be disturbed in that the pipette tips collide with inner walls in the frame. According to a further embodiment, the side walls are provide with vertically running ribs on their inner side, which stiffen the side walls. The vertically running ribs can be dimensioned such that they grasp only slightly into the inner space of the frame and a great free cross section for accommodating pipette tips remains between the side walls.

According to one embodiment, the plate features a gripping edge projecting beyond the upper side of the plate on each one of at least two opposite edges. The gripping edges can be used as additional contact surfaces by the gripping tool of an automatic machine. Further, the gripping edges can serve as protection—and gripping edges for preventing the contamination of the pipette tips in the manual assembly of a carrier with the plate. Preferably, the gripping edges project from the upper side of the plate at least as high as the pipette tips that are inserted into the plate. The gripping edges may be arranged on the two longitudinal edges of the plate. In addition or instead of this, they may also be arranged on the two front side edges of the plate.

According to a further embodiment, the carrier has a cover cap with a cover cap bottom and cover cap side walls projecting towards the downside from the edge of the cover cap bottom which can be put onto the frame. The cover cap covers pipette tips at the topside that are held in the frame by way of a plate. In order to position the cover cap on the carrier, the frame has a circumferential shoulder on the outside onto which the cover cap can be put with the lower edge of the cover cap side walls. The accurate positioning favours the sealing of the cover cap with respect to the frame. The circumferential shoulder on the outside can be formed on an outwardly projecting upper projection which limits a waistline.

According to a further embodiment, the cover cap has an edge surface limiting the shoulder at the outside, which is aligned with a further edge surface that limits at least the lower edge of the cover cap side walls at the outside when the cover cap is put up. The edge surfaces aligned with each other can be used for attaching a sealing adhesive tape. Sterile custody of pipette tips in the carrier can be made sure by the adhesive tape.

According to a further embodiment, the dimensions of the ground area of the frame exceed the outer dimensions of the frame in the region of the upper edge surface. By this, it can be made sure that the dimensions of the carrier do not exceed the SBS-format even when an adhesive tape for sealing a cover cap is attached. The difference of the dimensions is preferably 0.05 to 1 mm. More preferably it is 0.1 to 0.5 mm.

According to a further embodiment, the bottom is a hollow bottom having a downwardly projecting enclosure, the bottom being adapted to be put onto the upper edge of the cover cap. The enclosure can laterally grasp over the cover cap side walls or guiding bridges that project upward from the cover cap. This permits safe stacking of several carriers one above the other.

According to a further embodiment, the cover cap features deepenings in the outer sides of two opposing cover cap side walls. The deepenings permit a positively fitting contact to a gripping tool of an automatic machine, and so they favour the automatic lifting of the cover cap. Further, when the cover cap is made transparent, the deepenings favour the read-out of a tag on the upper edge of the carrier, which can be realised as a bar code for instance.

According to a further embodiment, the carrier comprises a frame-shaped distance piece, which is adapted to be put onto the upper side of a plate with its lower edge outside of the holes, and with its upper edge onto the lower side of a plate outside of the holes. The distance piece permits to stack several plates filled with pipette tips onto one single frame. In this, the lowermost plate filled with pipette tips is arranged directly on the frame. A distance piece is arranged on this lowermost plate, and on the distance piece in turn a plate filled with pipette tips. If need be, further distance pieces and plates are alternately disposed on this. The distance piece prevents that pipette tips arranged in different plates are pressed into each other, and that the pipette tips of a plate disposed below are lifted along when a plate is lifted.

According to one embodiment, the distance piece has an intermediate bottom with further holes. When a plate with inserted pipette tips is put onto the distance piece, the pipette tips are guided by the further holes, so that they are safely guided into the upper openings of pipette tips that are inserted into a plate that is disposed below. Preferably, these further holes are dimensioned such that they prevent pipette tips of a plate disposed below from being lifted along when a plate with inserted pipette tips is lifted. The pipette tips of the deeper disposed plate are held on the holes and fall back into the deeper disposed plate. The stack is positioned by the partly intermeshed pipette tips in plates that are disposed one above the other. A cover cap may be slackly positioned on the uppermost plate.

BRIEF DESCRIPTION OF THE SEVERAL VIEWS OF THE DRAWINGS

The present invention is explained in the following, by means of the attached drawings of an example of its realisation. The drawings show.

DETAILED DESCRIPTION OF THE INVENTION

While this invention may be embodied in many different forms, there are described in detail herein a specific preferred embodiment of the invention. This description is an exemplification of the principles os the invention and is not intended to limit the invention to the particular embodiment illustrated.

In the present application, the designations "up" and "down", as well as "vertical" and "horizontal" are related to an arrangement of the carrier in which the same is put onto a ground with a downside edge or a bottom of the frame, and pipette tips inserted into a plate that is put onto the frame are kept in a distance from the ground.

Figure 1:
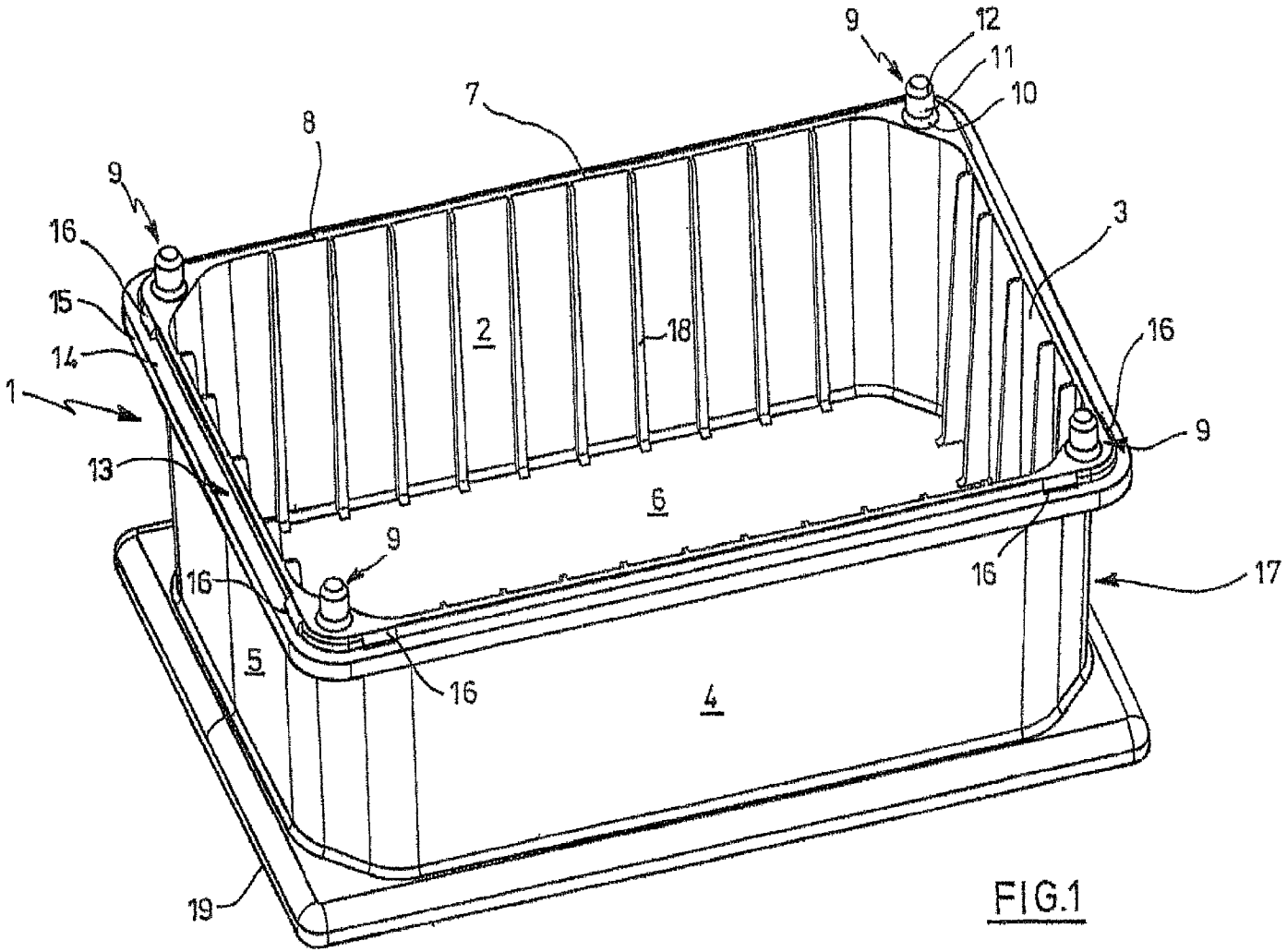
FIG. 1 a frame of the carrier provided with a bottom, in a perspective view at slant angle from the upside and from the side.

According to FIG. 1, a frame 1 has four side walls 2, 3, 4, 5. From these, two opposing side walls 2, 4 are longer than two other opposing side walls 3, 5. The side walls 2 to 5 stand up from a bottom 6. The bottom 6 has an approximately rectangular shape. At the outside, it projects somewhat over the side walls 2 to 5. Its length and width correspond to the dimensions of the ground area according to the SBS standard.

On its upper edge 7, the frame 1 has a flat contact surface 8, which circulates along the side walls 2 to 5, parallel to the bottom 6 or horizontally, respectively. The contact surface 8 is somewhat widened at the corners between the side walls 2 to 5. In each corner, a column 9 projects vertically from the contact surface 8, which has conical base section 10, a cylindrical centre section 11 and a conical end section 12.

At the outside, a step 14 circulates on the upper edge 7 on the topside of an upper projection 13, which is also formed flat and parallel to the bottom 6. The upper projection 13 is arranged somewhat below the contact surface 8. At the outside, the step 14 is limited by a circumferential, vertically aligned edge surface 15 of the upper projection 13. Between the upper projection 13 and the contact surface 8, positioning noses 16 project from the frame 1 towards the outside.

The upper projection 13 and the bottom 6 projecting at the downside limit a circumferential waistline 17 of the frame 1. On the inner sides, the side walls 2 to 5 feature ribs 18. These extend from the bottom 6 up to the upper edge 7.

The bottom 6 is a hollow bottom with a circumferential downwardly projecting enclosure 19, whose underside is flat and forms a standing surface. Further, ribs 20 running in parallel to its transversal side edges project from the underside of the bottom 6 (compare FIG. 6).

The frame 1 can be made from plural parts. Preferably it is made in one single piece. Further preferably, it is made of plastic material. It is preferably injection moulded. In order to create the waistline 17, the frame 1 has to be injection moulded by means of a slider tool.

As materials, polypropylene (PP), polycarbonate (PC), acrylonitrile-butadiene-styrene-copolymer (ABS), polystyrene (PS) or a metal (aluminium for instance, if need be anodized) are contemplated in particular. Polypropylene is particularly cost-saving. Polycarbonate and metal have the advantage to be treatable in an autoclave, and thus to be re-usable. The frame is preferably made of polypropylene. Unfilled or filled (with glass fibres for instance) polypropylene may be used. Filled polypropylene has a higher tenacity than unfilled polypropylene.

Figure 2:
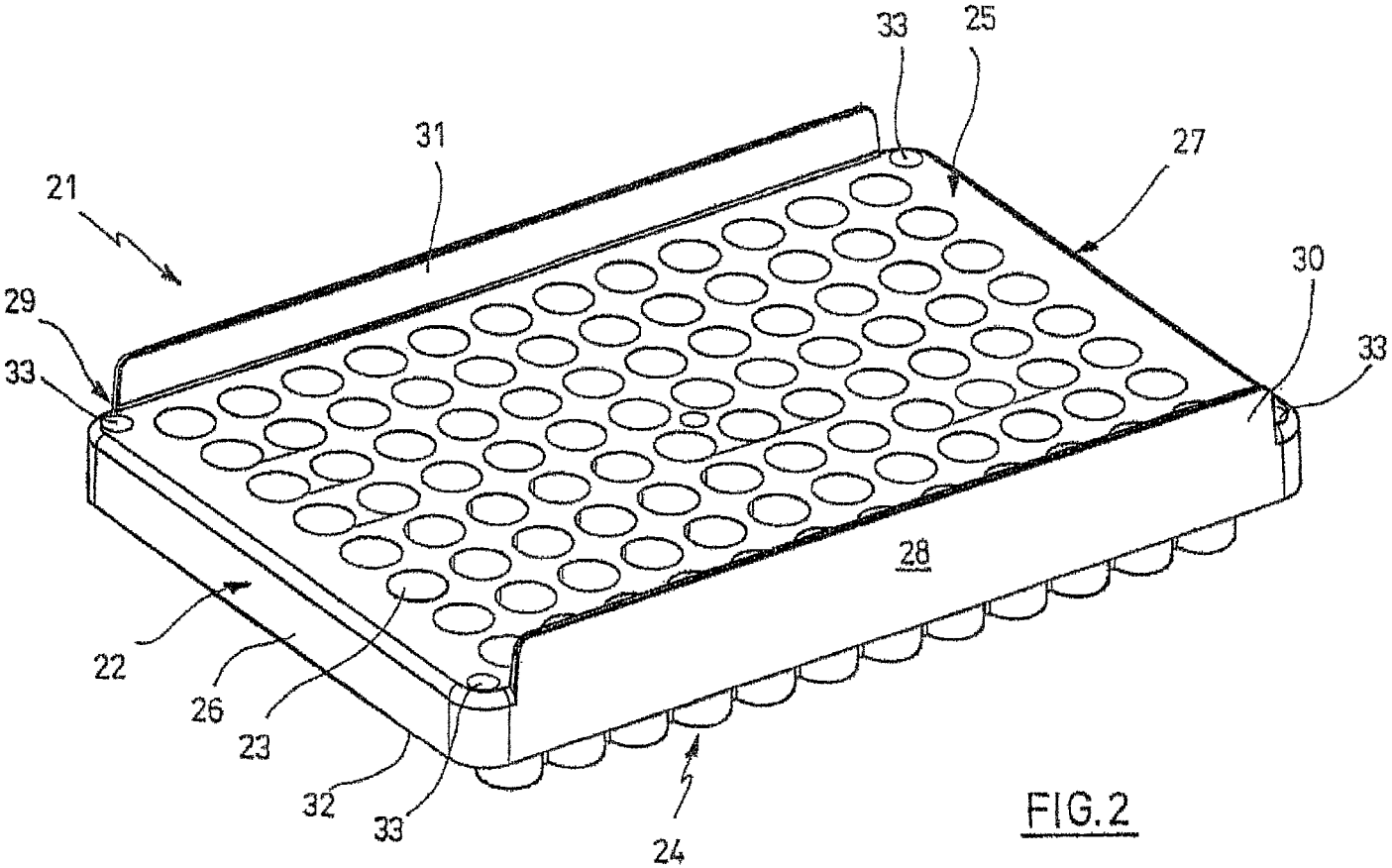
FIG. 2 a plate of the carrier, in a perspective view at slant angle from the upside and from the side.
Figure 3:
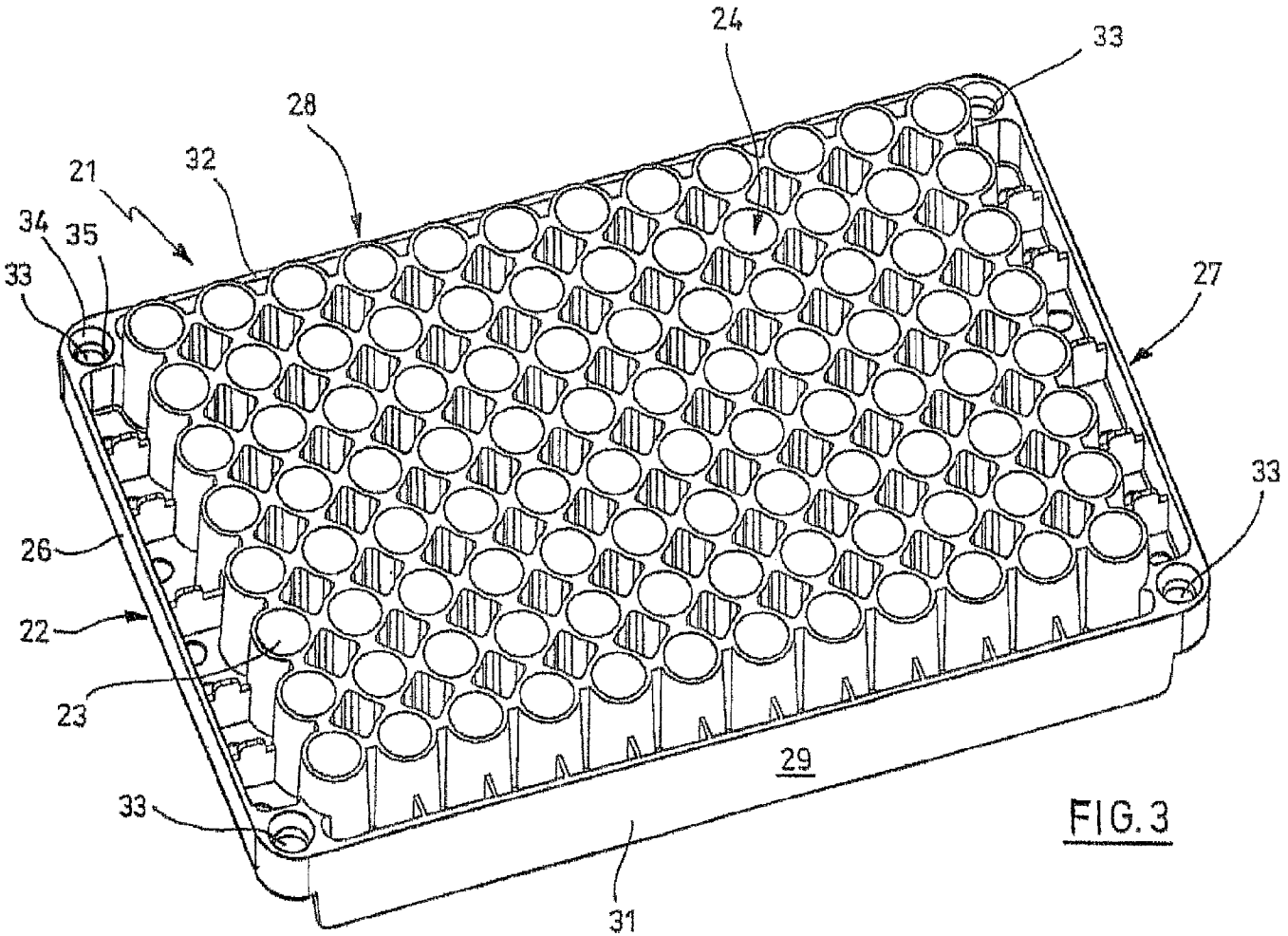
FIG. 3 the same plate, in a perspective view at slant angle from the downside and from the side.

According to FIGS. 2 and 3, a plate 21 has a substantially board-shaped base body 22 with a plurality of holes 23, which extend from the underside 24 to the upside 25 of the base body 22.

The holes 23 are arranged regularly in rows and columns of a matrix. In the example there are 96.

The plate 21 has two short edges 26, 27 and two long edges 28, 29. At each of the long edges 28, 29 it has one board-shaped gripping edge 30, 31 that projects over the upper side 25.

On the downside 24, the board shaped base body 22 has a further flat contact surface 32 that circulates on the edge. The further contact surface 32 is arranged somewhat above the lower openings of the holes 23. In the corners of the board-shaped base body 22, it has widenings in which through bores 33 are arranged.

Each bore 33 has a conical section 34 at the downside, and adjoining to this a cylindrical section 35. The dimensions of the bores 33 are selected such that the columns 9 are insertable with a clearance. The conical sections 34 form insertion slopes which facilitate the insertion of the columns 9 into the bores 33. Moreover, the conical end sections 12 of the columns 9 facilitate the insertion into the bores 33.

In the example, the plate-shaped base body 22 is realised as a quiver plate. In the same, the holes 23 are formed in quiver—or sleeve shaped structures, which are laterally connected by bridges and on the upper edge by a plate, and are enclosed by a circumferential edge. Instead, the plate 21 may also be formed as a bridge plate, wherein a thin plate with a plurality of holes 23 features bridges that enclose the holes at its downside. Realisations as a quiver—or bridge plate are materials saving and stable and laterally support the pipette tips that are inserted into the holes. Instead, the plate can also be realised massively, i.e. without cavities outside of the holes 23 and bores 33.

The plate 21 is preferably made in one single piece. Further preferably it is made of plastic material. It is preferably injection moulded. The plastic materials polypropylene (PP), polycarbonate (PC), acrylonitrile-butadiene-styrene-copolymer (ABS) and polystyrene (PS) can be used in particular. The frame 1 and the plate 21 can be made of the same or of different materials. For instance, the frame 1 can be made in a cost-saving way of polypropylene, and the plate 21 of polycarbonate, so that the plate is particularly stable. A further example is a frame 1 of polycarbonate adapted for autoclave treatment, and a cost-saving plate 21 of polypropylene, wherein a sufficient stability can be made sure by the structure of the plate 21. Polypropylene is preferably used for the plate 21.

Figure 4:
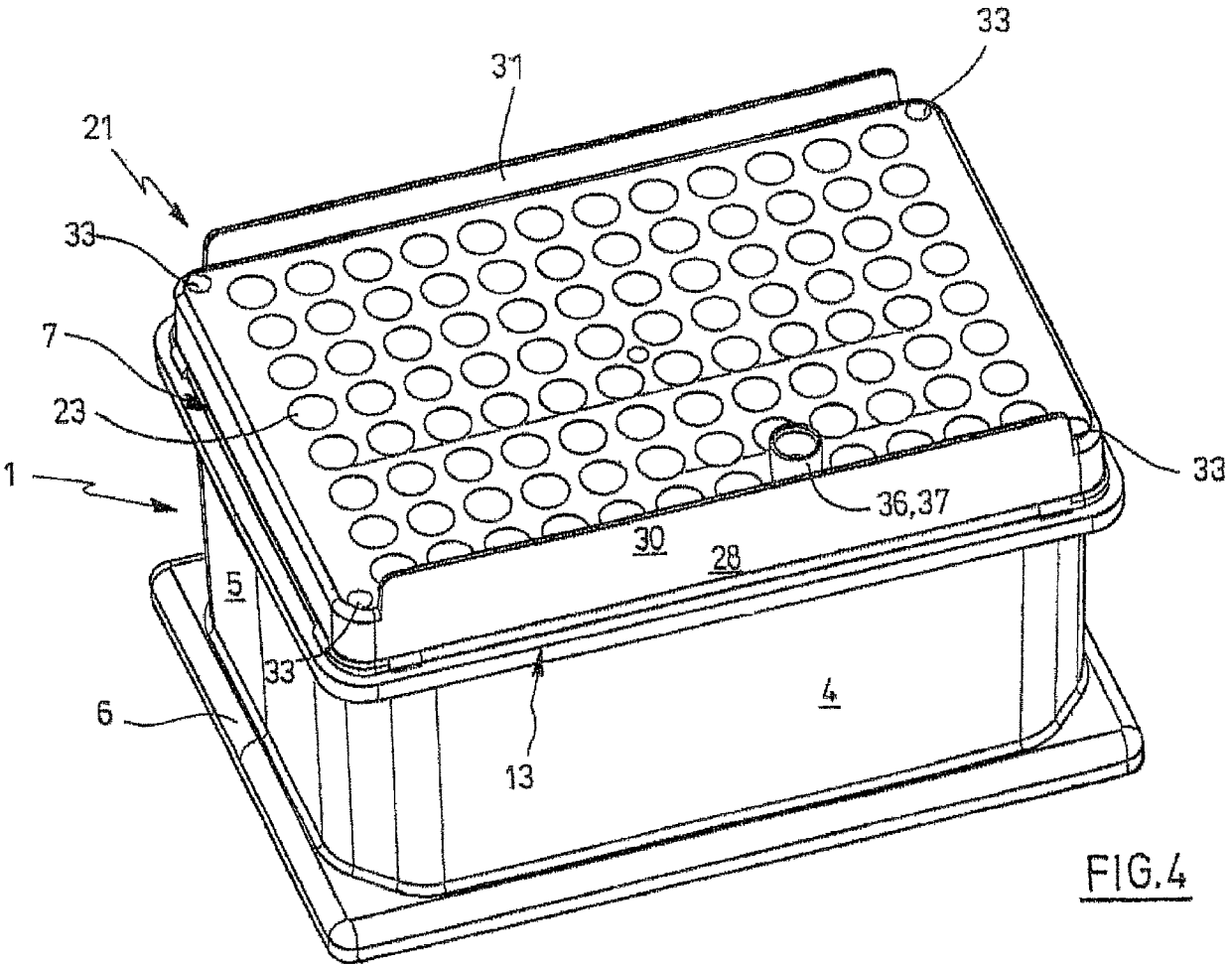
FIG. 4 the plate when put onto the frame, in a perspective view at slant angle from the upside and from the side.
Figure 11:
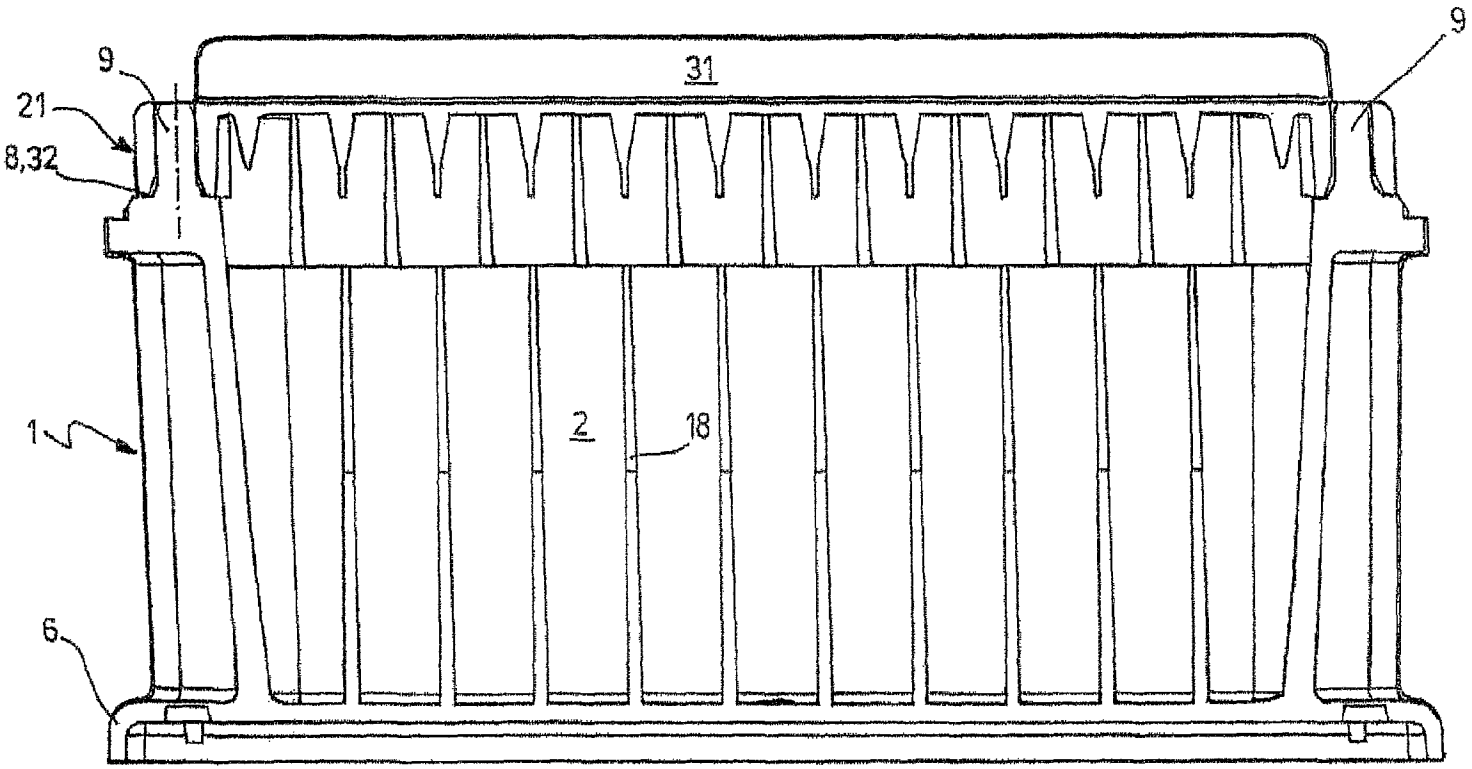
FIG. 11 the same arrangement as FIGS. 5 and 6 in a vertical section.

According to FIGS. 4 and 11, the plate 21 is put onto the upper edge 7 of the frame 1. The further contact surface 32 (see FIG. 2) rests on the contact surface 8 (see FIG. 1), and the columns 9 grasp into the bores 33. For the sake of illustration, in FIG. 4 a pipette tip 36 is set into a hole 23 of the plate 21 from out the upside. The pipette tip 36 has a widening 37 at its upper side, which prevents it from falling through the hole 23.

When the lugs of a metering tool are pressed into the upper openings of eight pipette tips, the plate 21 is loaded with a force of about 100 to 400 Newton, preferably 200 to 300 Newton, about 240 Newton in particular. Even when made of polypropylene, the plate 21 resists these loads due to its structure and its support via circumferential contact surfaces 32 without disadvantageous bending. The frame 1, even when made of polypropylene, is also not overburdened in this.

Figure 12:
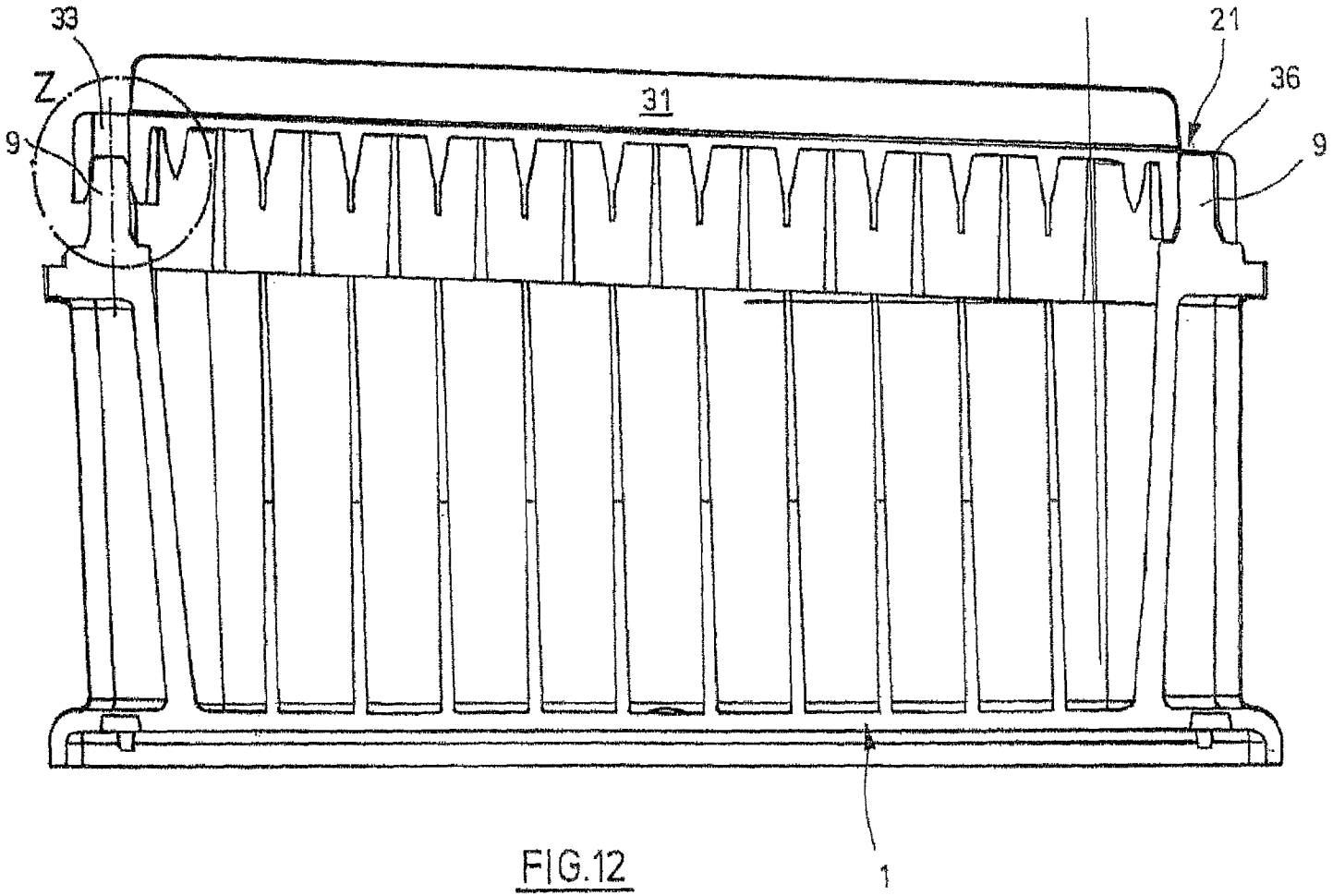
FIG. 12 the same arrangement with swung and wedged cover cap in a vertical section.
Figure 13:
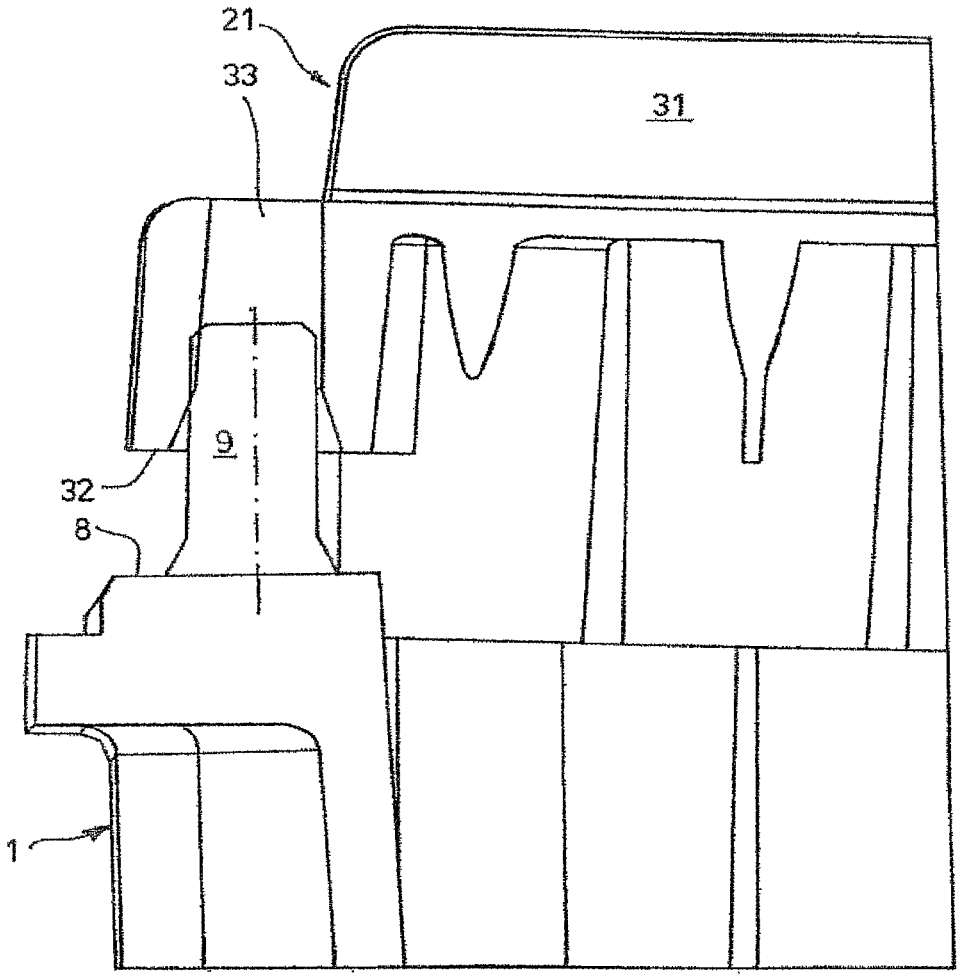
FIG. 13 an enlarged detail of FIG. 12.
Figure 14:
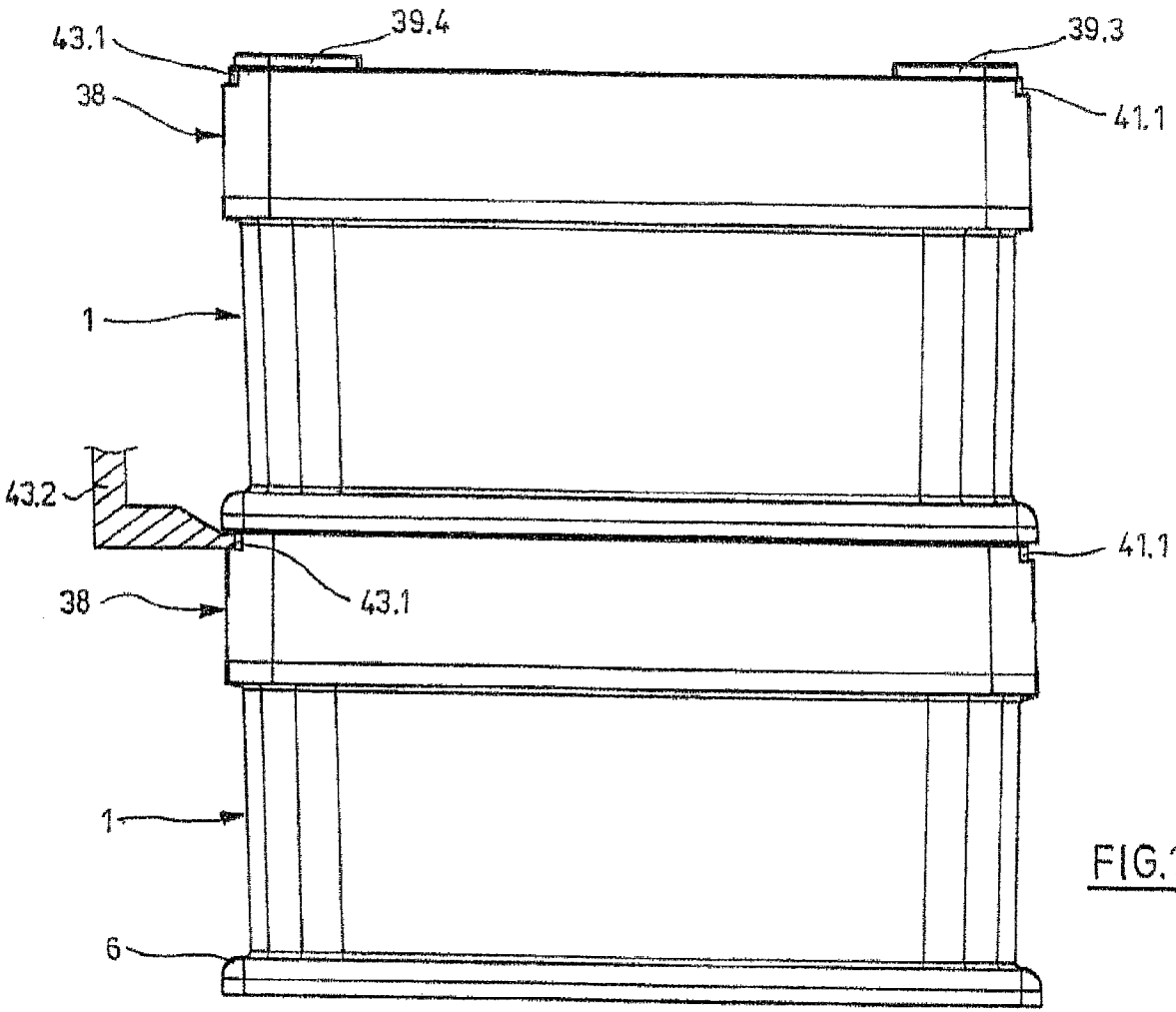
FIG. 14 arrangements according to FIGS. 5 and 6, stacked one above the other in a side view.

When the plate 21 is lifted through pipette tips 36 that hook itself up in the removal of pipette tips 36, the plate 21 gets tilt or is inclined, respectively. This is due to the asymmetrical weight distribution of the plate 21 with respect to the hooked-up pipette tips 36. As a consequence, the columns 9 wedge themselves in the bores 33 (compare FIGS. 12 and 13). Through this, the plate 21 is stripped off by the lifted pipette tips 36 and falls back into the starting position.

The shape of the columns 9 and the bores 33 as well as the clearance between them facilitate to put the plate 21 onto the frame 1. However, the plate 21 is safely held on the frame 1. A safe transportation can be performed by a gripping tool of an automatic machine. The gripping tool may enclose the frame 1 on the outer sides of opposing side walls 2, 4 or 3, 5 on the waistline 17. The outwardly projecting projection 13 and the bottom 6 prevents the gripping tool from slipping through.

The edges 26 to 29 of the plate 21 can be accessed from the outside and may be easily grasped by a gripping tool. The gripping tool catches preferably on the longer edges 28, 29, which are provided with the upside-projecting gripping edge 30, 31. A gripping edge may have other elements in addition, like piercings, deepenings, elevations and so on, which permit gripping with positive fit, by gripping arms in particular.

Further, the plate 12 can be grasped manually, in particular on the edges 28, 29 provided with the projecting gripping edge 30, 31. The gripping edge 30, 31 projecting beyond the upper side of the pipette tips 36 prevents contaminations of inserted pipette tips when this is done.

Figure 5:
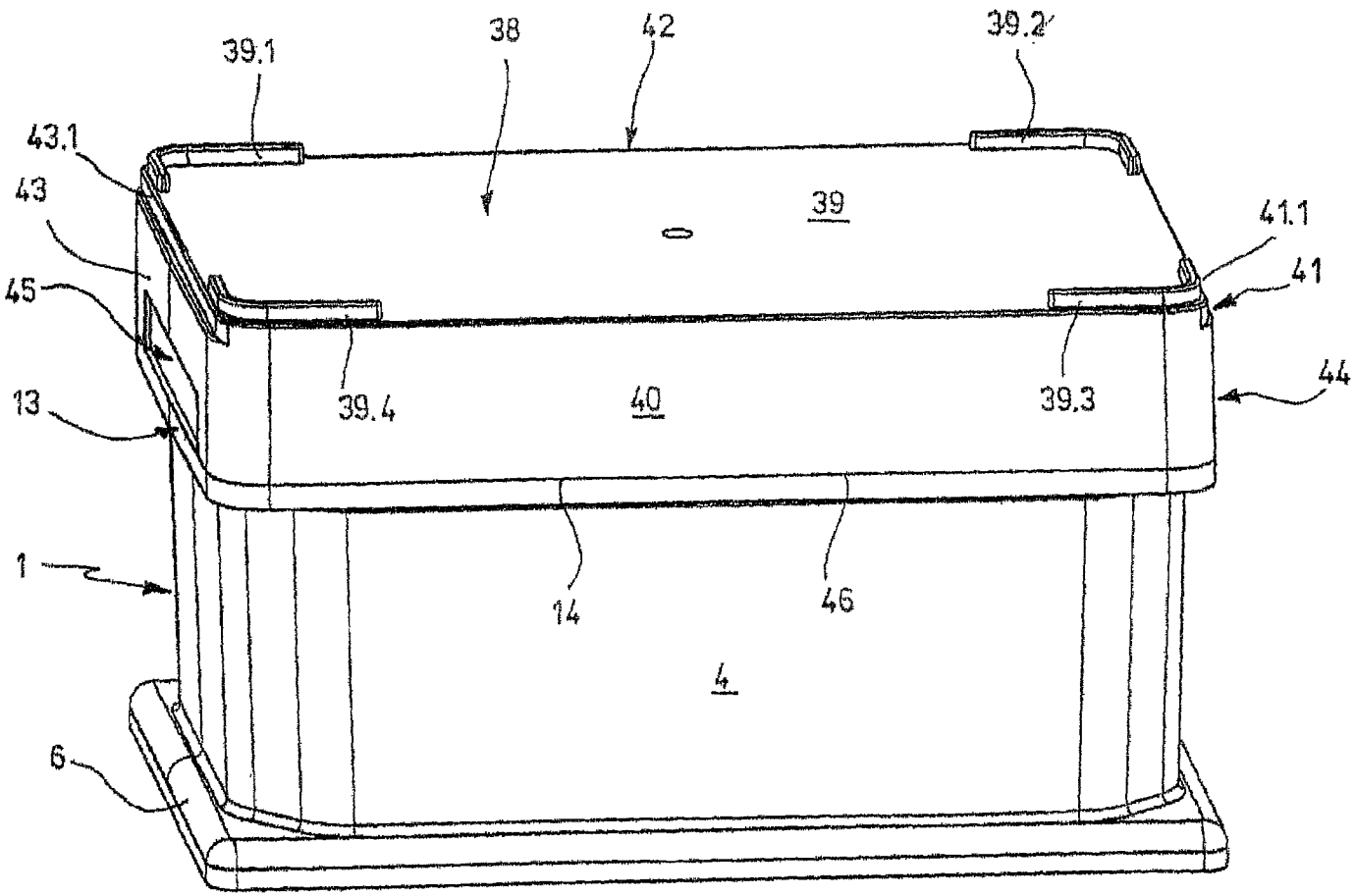
FIG. 5 the frame with plate being put up and cover cap being put up, in a perspective view at slant angle from the upside and from the side.
Figure 6:
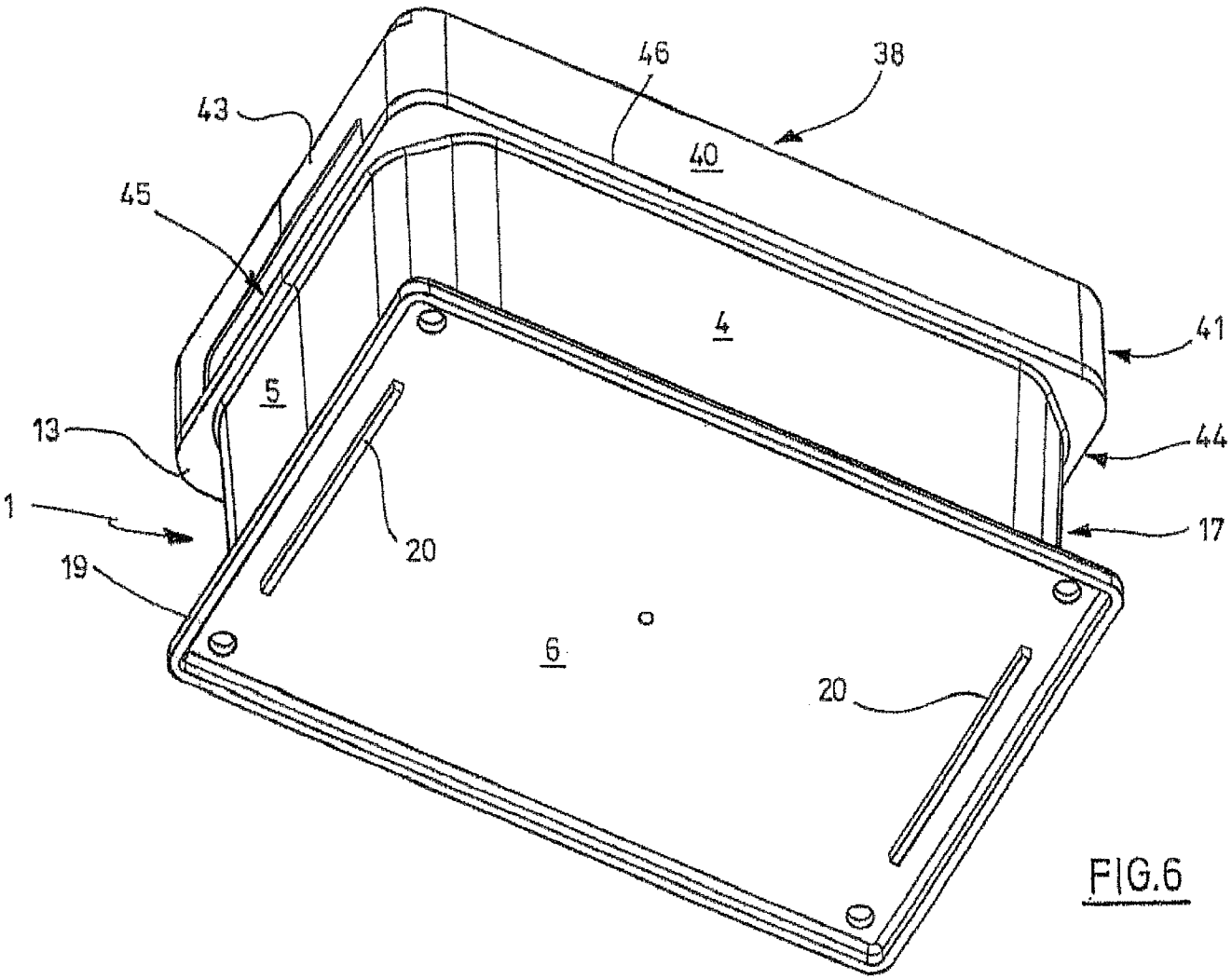
FIG. 6 the same arrangement, in a perspective view at slant angle from the downside and from the side.

According to FIGS. 5 and 6, a cover cap 38 has a flat cover cap bottom 39 and cover cap side walls 40 to 43 that laterally project downward from it. The opposing short cover cap side walls 41, 42 each have a deepening 44, 45. The cover cap side walls 40 to 43 sit on the step 14 with their lower edge 46. They are guided on the positioning noses 16 at their inner sides. The cover cap 38 covers up a plate 21 with inserted pipette tips 36 that is put onto the frame 1. The outer sides of the cover cap side walls 40 to 43 and the edge surface 15 are aligned with each other and can be used for attaching an adhesive tape, which sealingly connects the cover cap 38 with the frame 1.

A gripping tool can grasp into the deepenings 44, 45, in order to pull off the cover cap 38 automatically from the frame 1. Further, on a narrow side 26, 27 of the plate 21, a tag can be read through the deepenings from the outside. The cover cap 38 is preferably made of a transparent material for this purpose.

On the upper side of its bottom 39, the cover cap 38 has upwardly projecting ribs 39.1 to 39.4 on its corner region. Further, it has recesses 41.1, 43.1 on the upper edges of its cover cap side walls 41, 43. A frame 4 can be put onto the upper side of a top lid 38 with its bottom 6. At the inside, the enclosure 19 of the bottom 6 is guided on the ribs 39.1 to 39.4. Blade-shaped separation tools 43.2 can be inserted into the recesses 41.1, 43.1, in order to separate frames 4 and cover caps 38 that are arranged one above the other in a stack (compare FIG. 4).

The cover cap 38 is preferably made in one single piece. Plastic materials are used preferably. It is preferably injection moulded. For instance, the plastic materials polycarbonate (PC), polystyrene (PS), polypropylene (PP) or acrylonitrile-butadiene-styrene-copolymer (ABS) can be used. Preferably used is polycarbonate or polystyrene, because these materials permit the production of a cover cap 38 that is as clear as glass.

Figure 7:
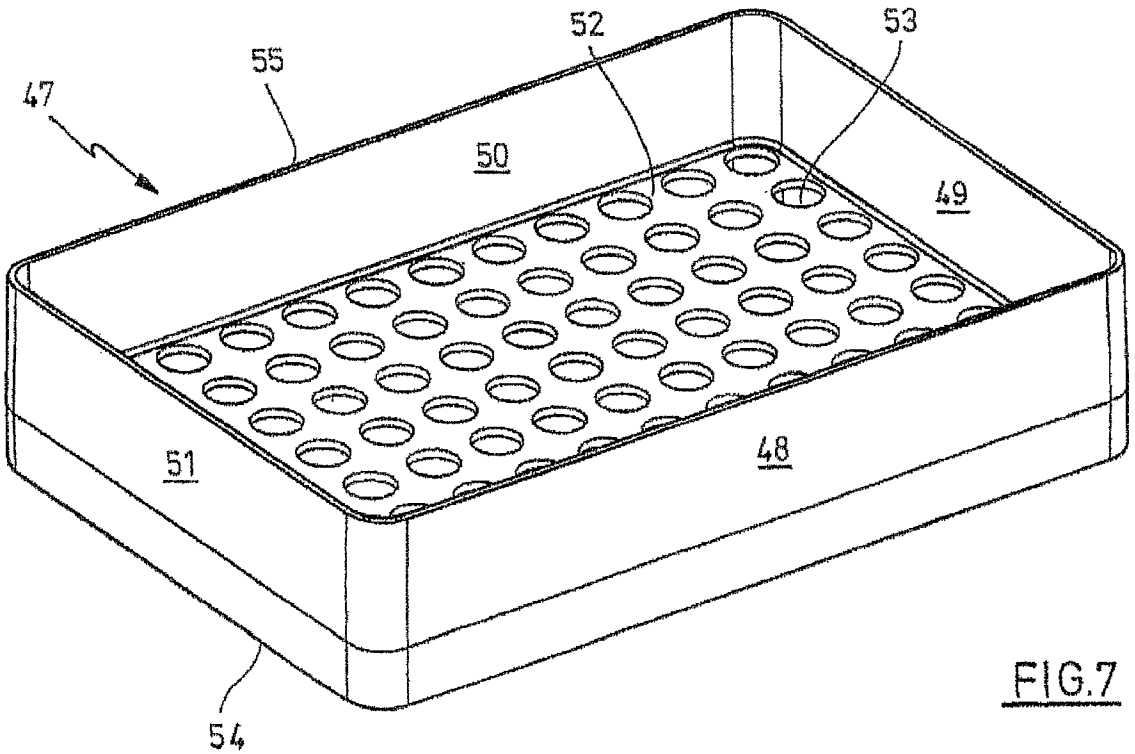
FIG. 7 a distance piece of the carrier, in a perspective view at slant angle from the upside and from the side.

According to FIG. 7, the carrier features a frame-shaped distance piece 47. The same has four vertical distance piece side walls 48 to 51, which are connected to each other on the corners. Further, the distance piece has an intermediate bottom 52 with 24, 48, 96, 383 or 1.536 further through holes 53, which are in a matrix arrangement corresponding to the holes 23 of the plate 21.

The distance piece 47 is preferably made in one single piece. Plastic materials are used preferably. It is preferably injection moulded. But it may also be produced as a deep-drawn piece. For instance, the plastic materials polypropylene (PP), polystyrene (PS), polycarbonate (PC), or acrylonitrile-butadiene-styrene-copolymer (ABS) can be used. Preferably used is polystyrene, because it is particularly cost-saving.

Figure 8:
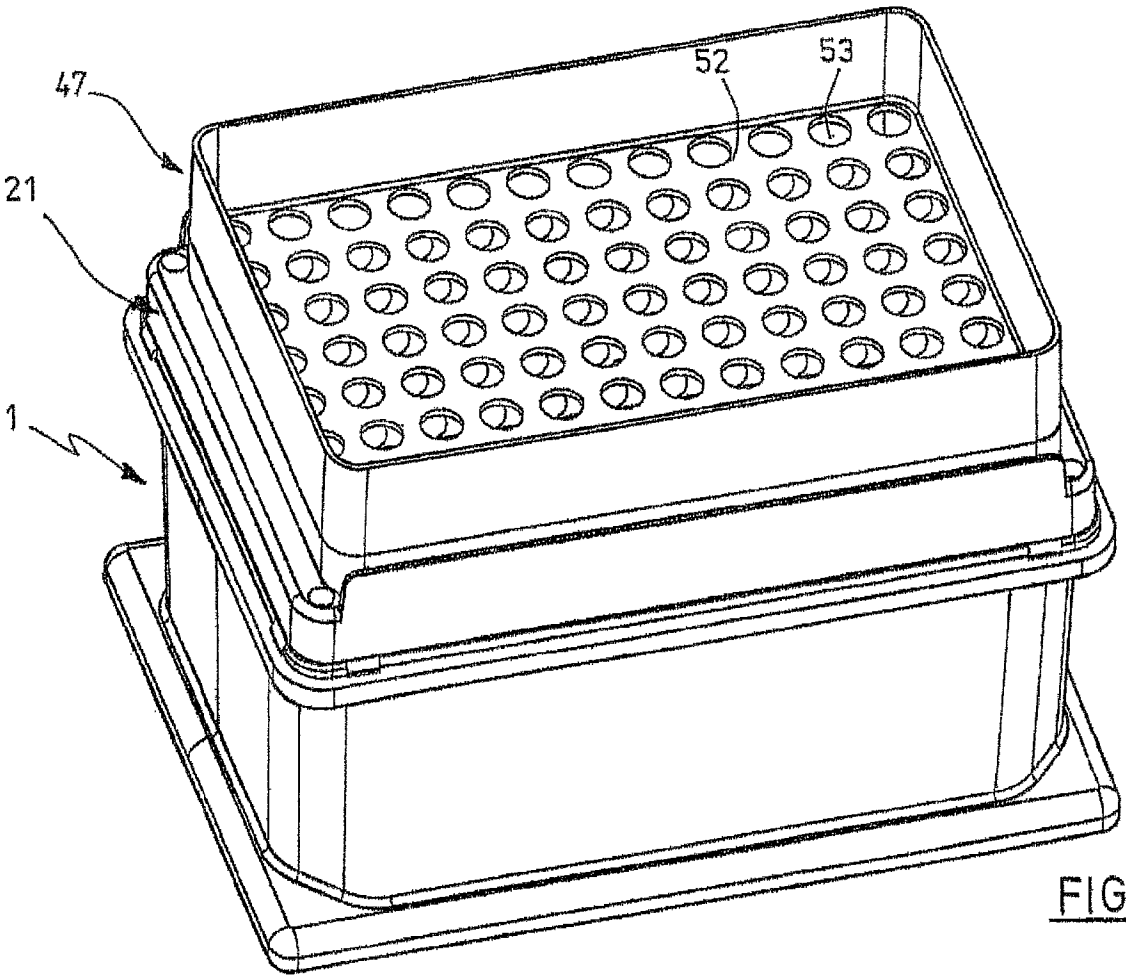
FIG. 8 the distance piece put onto an arrangement of a frame and a plate put up thereon, in a perspective view at slant angle from the upside and from the side.

According to FIG. 8, the distance piece 47 is put with its lower edge 54 onto the upper side of a plate 21 which is put onto a frame 1.

Figure 9:
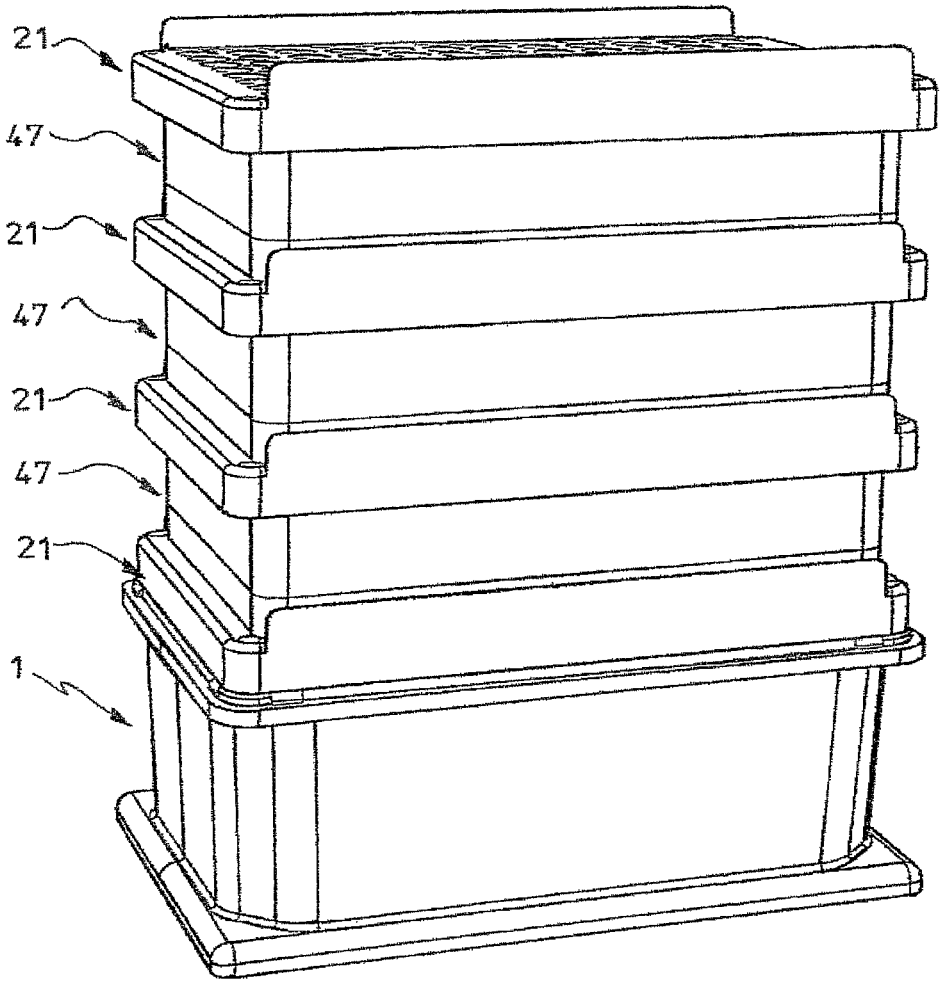
FIG. 9 a frame with several plates and distance pieces being put up thereon, in a perspective view from the side.

According to FIG. 9, a further plate 21 is put onto the upper edge 55 of the distance piece 47, and onto this plate a further distance piece 47 and so on.

Figure 10:
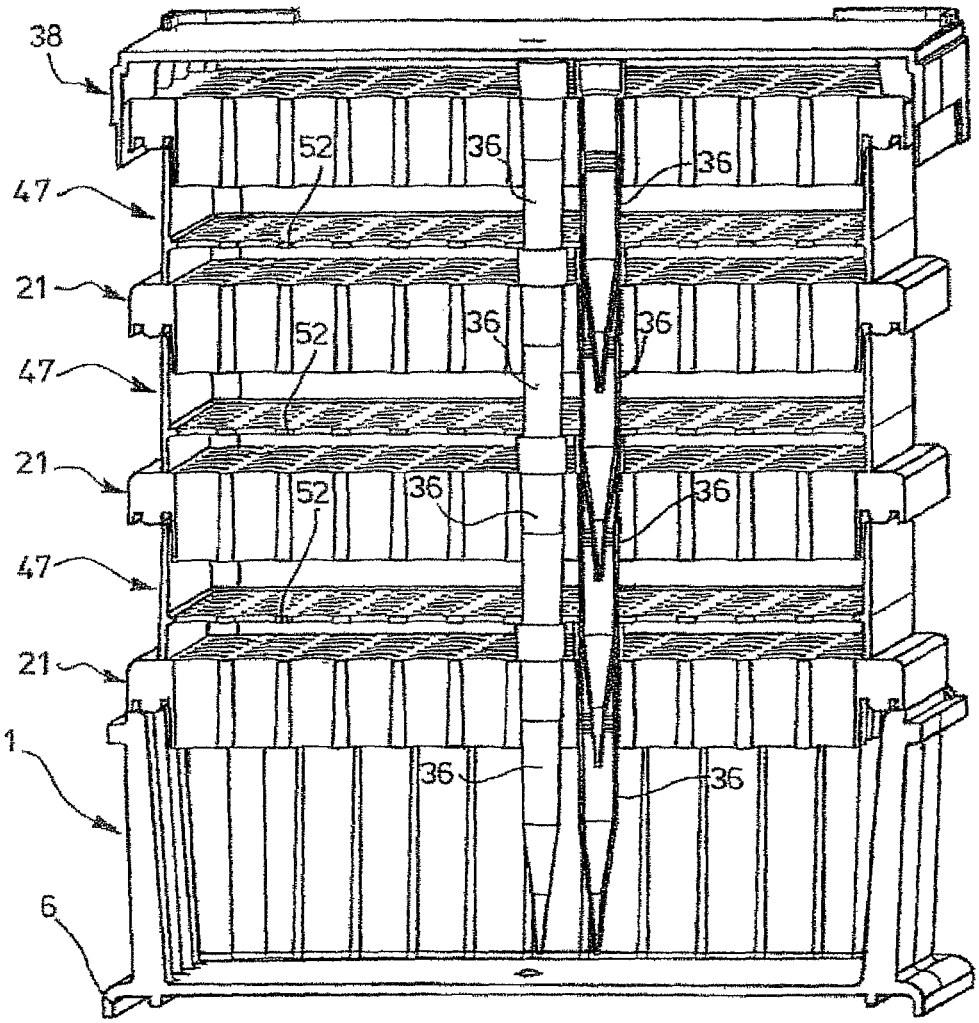
FIG. 10 a frame with several plates and distance pieces being put up, wherein the plate is filled with tips and a cover cap lays on the uppermost plate, in a perspective view from the side.

Pipette tips 36 that are inserted into the plate 21 are laterally guided by the further holes 33 of distance pieces 47 which are arranged in the intermediate bottoms below. Through this, erroneous alignments of pipette tips 36 in the automatic or manual stacking of filled plates 21 are avoided. When the plate 21 is lifted, the intermediate bottom 52 prevents pipette tips 36 from being taken along by plate 21 which disposed below. In order to cover up the arrangement, a cover cap 38 may be slackly put onto the uppermost plate 21 (compare FIG. 10).

This completes the description of the preferred and alternate embodiments of the invention. Those skilled in the art may recognize other equivalents to the specific embodiment described herein which equivalents are intended to be encompassed by the claims attached hereto.

What is claimed is:

1. A carrier for pipette tips, with
a frame (1), featuring four side walls (2 to 5),
a plate (21) with a plurality of holes (23) for inserting pipette tips (36) and
means for detachably connecting the frame (1) and the plate (21),
that have contact surfaces (8, 32) on the upper edge (7) of the flame (1) and on the underside (24) of the plate (21), which touch each other when the plate is put onto the flame (1), and
that have guiding elements (9, 33) directed transversally to the contact surfaces on the frame (1) and on the plate (21), which engage into each other with lateral clearance when the plate (21) is put onto the frame (1), the lateral clearance being designed whereby in case that hooked-up pipette tip occurs in an erroneous withdrawal by a metering tool and the plate is lifted along with the pipette tip through this and is in danger to fall out, there will be a toe-in between the guiding elements that engage with lateral clearance resulting in a release of the hooked-up pipette tip from the plate, so that the plate slips back onto the frame into its original position.

2. A carrier for pipette tips according to claim 1, wherein the guiding elements (9, 33) are arranged at opposing side walls (2 to 5) of the frame (1) and at opposing edges of the plate (21).

3. A carrier according to claim 1, wherein the dimensions of the ground area of the frame (1) coincide with the dimensions of the ground area of microtiter plates according to the standard of the Society for Biomolecular Screening (SBS).

4. A carrier according to claim 1, wherein the frame (1) has a free cross section between the side walls (2 to 5).

5. A carrier according to claim 1, wherein the plate (21) features a gripping edge (30, 31) projecting beyond the upper side of the plate on each one of at least two opposite edges (28, 29).

6. A carrier according to claim 1, wherein the guiding elements include columns (9), and bores (33) suited for insertion of the columns with lateral clearance, and/or ribs and grooves that are suited for insertion of the ribs into said grooves with lateral clearance.

7. A carrier according to claim 6, wherein the columns (9) and/or the ribs project from the upper edge (7) of the frame (1) and the plate feature the bores (33) and/or grooves in the underside (24).

8. A carrier according to claim 6, wherein said guiding elements include columns (9) and/or ribs, the columns (9) and/or ribs taper at least in sections in the direction towards their free end, and/or wherein the bores (33) and/or grooves widen up at least in sections in the direction towards their insertion openings for the columns (9) and/or ribs.

9. A carrier according to claim 6, wherein the columns (9) and the bores (33) are disposed on the corners of the frame (1) and the plate (21).

10. A carrier according to claim 1, wherein the frame (1) features a waistline (17).

11. A carrier according to claim 10, wherein the waistline (17) is limited at the upside by an outwardly protruding upper projection (13), and/or at the downside by an outwardly protruding lower projection (6), respectively, of the frame (1).

12. A carrier according to claim 1, wherein the frame (1) is closed by a bottom (6) at its underside.

13. A carrier according to claim 12, wherein the bottom (6) is a hollow bottom having a downwardly projecting enclosure (19), the bottom being adapted to be put onto the upper edge (7) of a cover cap (38).

14. A carrier according to claim 1, with a cover cap (38) that is adapted to be set up slackly, having a cover cap bottom (39) and cover cap side walls (40 to 43) projecting towards the downside from the edge of the cover cap bottom which can be put onto the frame (1).

15. A carrier according to claim 14, wherein the cover cap (38) features deepenings (44, 45) in the outer sides of two opposing cover cap side walls (41, 43).

16. A carrier according to claim 14, wherein the upper edge (7) of the frame (1) has a circumferential shoulder (14) on the outside onto which the cover cap (38) can be put with the lower edge (46) of the cover cap side walls (40 to 43).

17. A carrier according to claim 16, wherein the frame (1) has an edge surface (15) limiting the shoulder (14) at the outside, which is aligned with a further edge surface that limits at least the lower edge (46) of the cover cap side walls (40 to 43) at the outside when the cover cap (38) is put up.

18. A carrier according to claim 17, wherein the dimensions of the ground area of the frame (1) exceed the outer dimensions of the frame (1) in the region of the edge surface (15).

19. A carrier for pipette tips, with a frame (1), featuring four side walls (2 to 5), a plate (21) with a plurality of holes (23) for inserting pipette tips (36) and means for detachably connecting the frame (1) and the plate (21), that have contact surfaces (8, 32) on the upper edge (7) of the frame (1) and on the underside (24) of the plate (21), which touch each other when the plate is put onto the frame (1), and that have guiding elements (9, 33) directed transversally to the contact surfaces on the frame (1) and on the plate (21), which engage into each other with lateral clearance when the plate (21) is put onto the frame (1), the lateral clearance being designed whereby in case that hooked-up pipette tip occurs in an erroneous withdrawal by a metering tool and the plate is lifted along with the pipette tip through this and is in danger to fall out, there will be a toe-in between the guiding elements that engage with lateral clearance resulting in a release of the hooked-up pipette tip from the plate, so that the plate slips back onto the frame into its original position; with a frame-shaped distance piece (47), which is adapted to be put onto the upper side of the plate (21) with its lower edge (54) outside of the holes (23).

20. A carrier according to claim 19, wherein the distance piece has an intermediate bottom (52) with a plurality of holes (53) for inserting pipette tips (36).

* * * * *

UNITED STATES PATENT AND TRADEMARK OFFICE

CERTIFICATE OF CORRECTION

PATENT NO. : 8,591,840 B2
APPLICATION NO. : 12/691198
DATED : November 26, 2013
INVENTOR(S) : Hanna Rethwisch and Michael Blumentritt It is certified that error appears in the above-identified patent and that said Letters Patent is hereby corrected as shown below:

In the Claims

Column 10, Line 45, delete “flame” and insert --frame--.

Column 10, Line 54, delete “engage” and insert --engage[d]--.

Column 12, Line 32, delete “engage” and insert --engage[d]--.

Signed and Sealed this
Eleventh Day of February, 2014

Michelle K. Lee

Michelle K. Lee
*Deputy Director of the United States Patent and Trademark Office*